US007106872B2

(12) United States Patent
Masters

(10) Patent No.: US 7,106,872 B2
(45) Date of Patent: Sep. 12, 2006

(54) LOCKING MECHANISM FOR ELECTRONICS MODULE FOR HEARING INSTRUMENTS

(75) Inventor: Martin W. Masters, Hillsborough, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 306 days.

(21) Appl. No.: 10/608,705

(22) Filed: Jun. 27, 2003

(65) Prior Publication Data

US 2004/0264722 A1 Dec. 30, 2004

(51) Int. Cl.
*H04R 25/00* (2006.01)

(52) U.S. Cl. ..... 381/322; 381/323

(58) Field of Classification Search ..... 381/322–324
See application file for complete search history.

(56) References Cited

U.S. PATENT DOCUMENTS 4,598,177 A 7/1986 McGroarty et al.
5,187,746 A 2/1993 Narisawa
5,347,584 A * 9/1994 Narisawa ..... 381/323
5,500,901 A * 3/1996 Geraci et al. ..... 381/323
5,889,874 A * 3/1999 Schmitt et al. ..... 381/328
2001/0036288 A1* 11/2001 Robinson et al. ..... 381/323

FOREIGN PATENT DOCUMENTS

WO WO 00/21336 4/2000

OTHER PUBLICATIONS

International Search Report.

* cited by examiner

*Primary Examiner*—Suhan Ni
*Assistant Examiner*—Phylesha Dabney
(74) *Attorney, Agent, or Firm*—Mark H. Jay; Joel Miller

(57) ABSTRACT

A force opposing tab on the peripheral surface of an electronics module will prevent inadvertent dislodging of the module from the hearing instrument housing when force is applied the battery door.

8 Claims, 8 Drawing Sheets

LOCKING MECHANISM FOR ELECTRONICS MODULE FOR HEARING INSTRUMENTS

BACKGROUND OF THE INVENTION

Various electrical components of a hearing instrument can be situated on a module that plugs into an opening in the housing of the instrument. The module has latches protruding from the bottom of the module that mate with the housing. A door on the module permits access to a battery.

To remove the hearing instrument from the user's ear, the opened door may be used as a handle. The force applied to the door to achieve removal may be of such magnitude that the latches slip off the mating surfaces, dislodging the module from the hearing instrument housing. To prevent this from happening, a tab may be provided on the module near where the door attaches to a hinge on the module. When the module is inserted into the opening of the housing, the tab slips under the surface of the opening and the latches snap into place. The tab opposes the force applied to the battery door, assuring that the module will remain in place.

DESCRIPTION OF THE INVENTION

Figure 1:
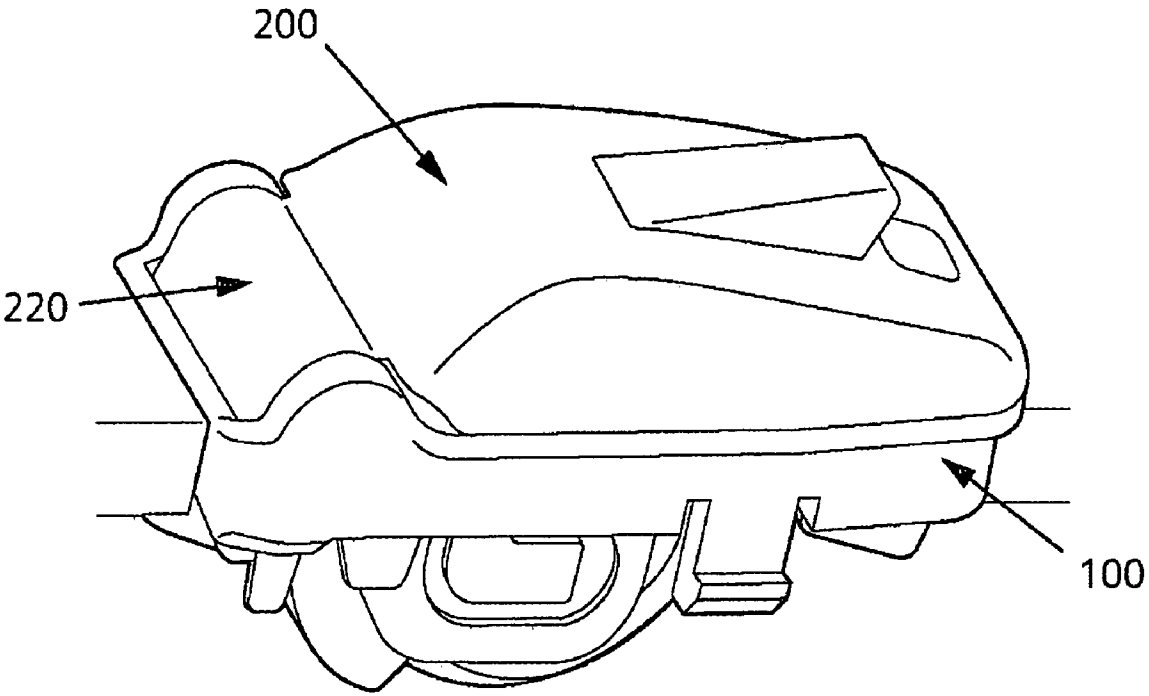
FIGS. 1 and 2 are drawings of a hearing instrument module with a battery door.
Figure 2:
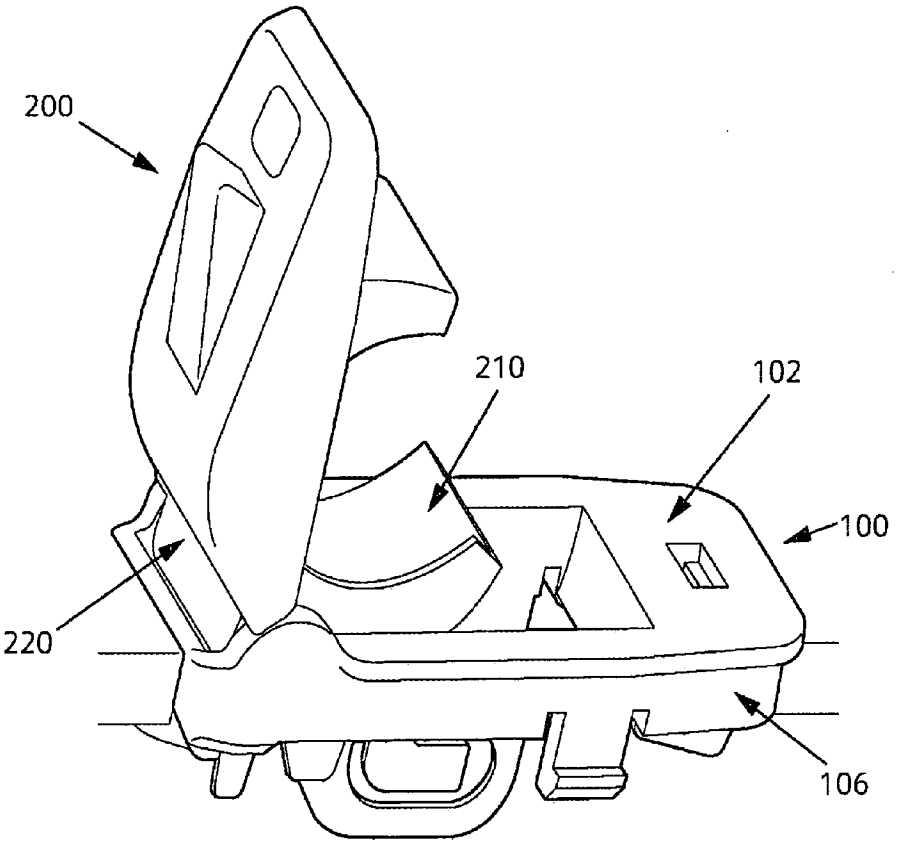

FIGS. 1 and 2 illustrate an electronics module 100 for a hearing instrument. The module 100 has an upper surface 102 on which there is a door 200 with a holder 210 for a battery (not shown) attached to the module 100 at a hinge 220.

Figure 3:
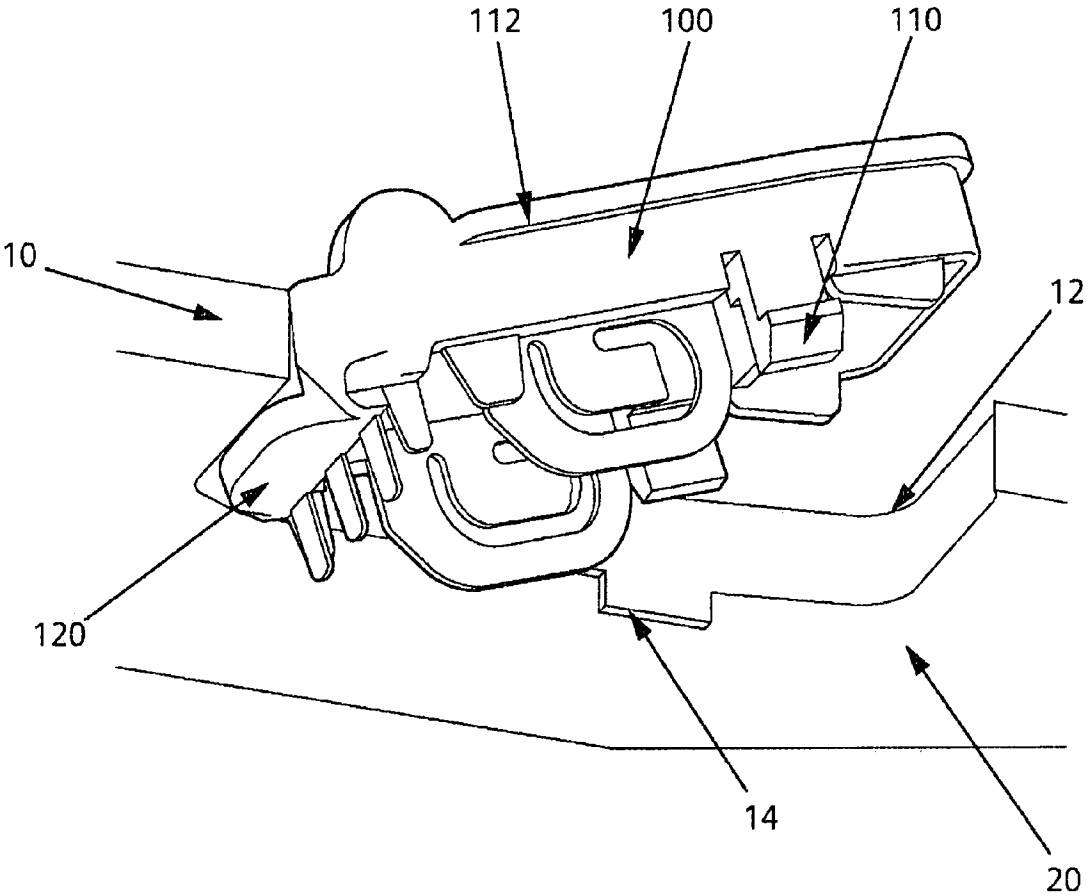
FIGS. 3–6 are perspective views of the module of FIGS. 1 and 2 inserted in the opening of a hearing instrument housing.

As can be seen in FIG. 3, the module 100 is inserted into an opening 12 in the hearing instrument housing 10. The shape of the opening 12 conforms to the peripheral surface 106 of the module 100. The hearing instrument housing 10 has inside and outside surfaces 20 and 30, respectively, that define a generally planar outer surface 40 near the opening 12 (see FIG. 4). As shown in the figures (see FIGS. 3, 4, 5, 6, and 8), the upper surface 102 has a flange 112 that rests on the outside surface 30 of the hearing instrument housing 10 and prevents the module 100 from falling through the opening 12. Latches 110 on the module 100 mate with protrusions 14 on the inside surface 20 of the hearing instrument housing 10 and serve to keep the module 100 in place after insertion in the opening 12. However, notwithstanding the presence of the latches 110, a significant amount of force may be applied to the door 200 when it is used to assist in removal of the hearing instrument from the user's ear that could result in dislodging the module 100 from the hearing instrument housing 10.

Figure 4:
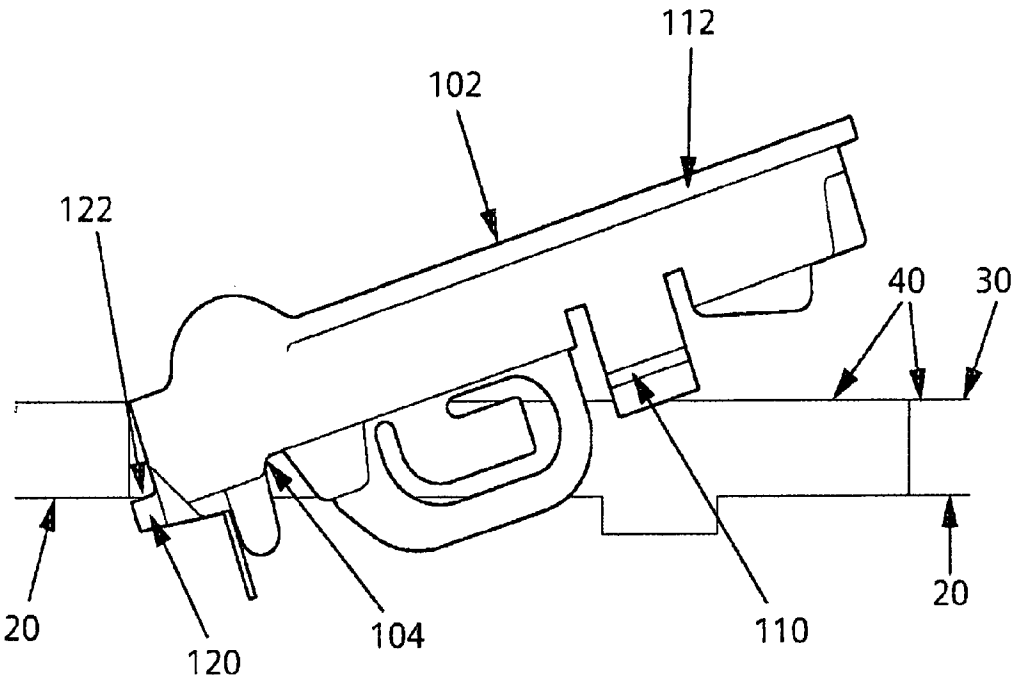
Figure 5:
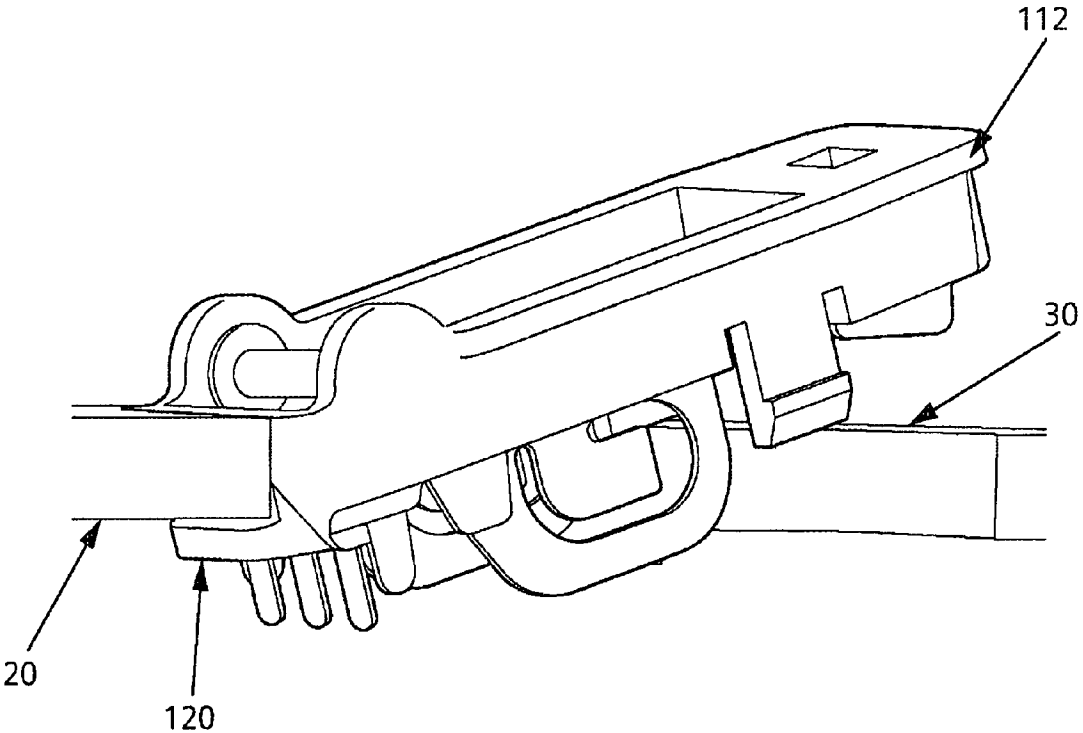
Figure 6:
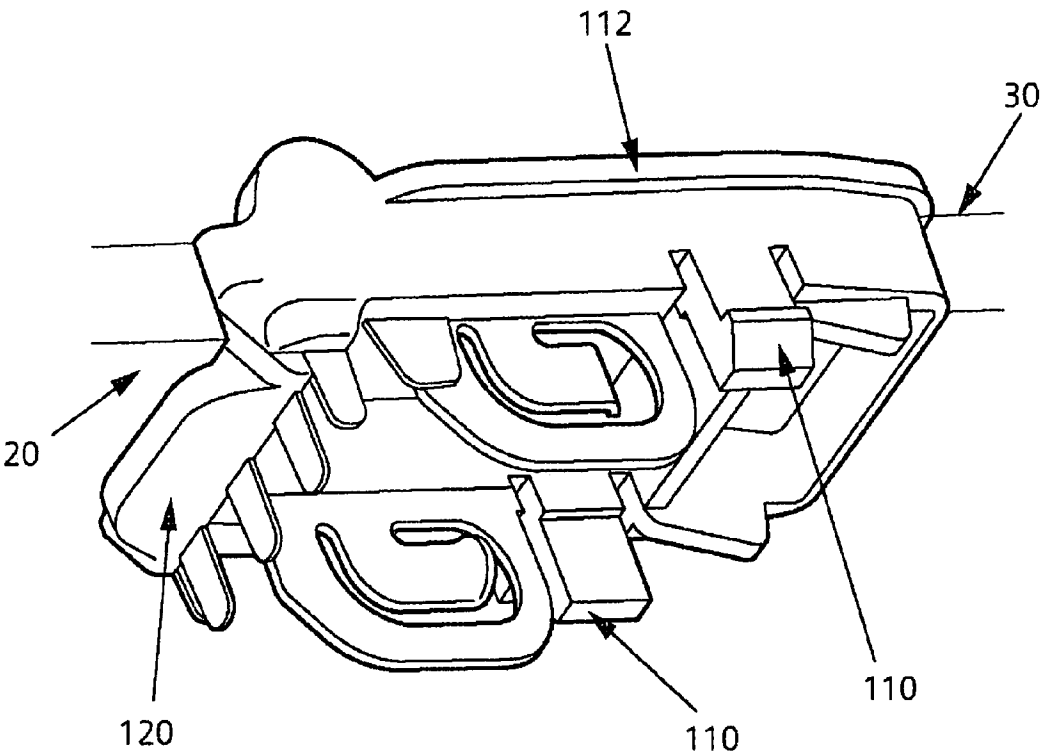
Figure 8:
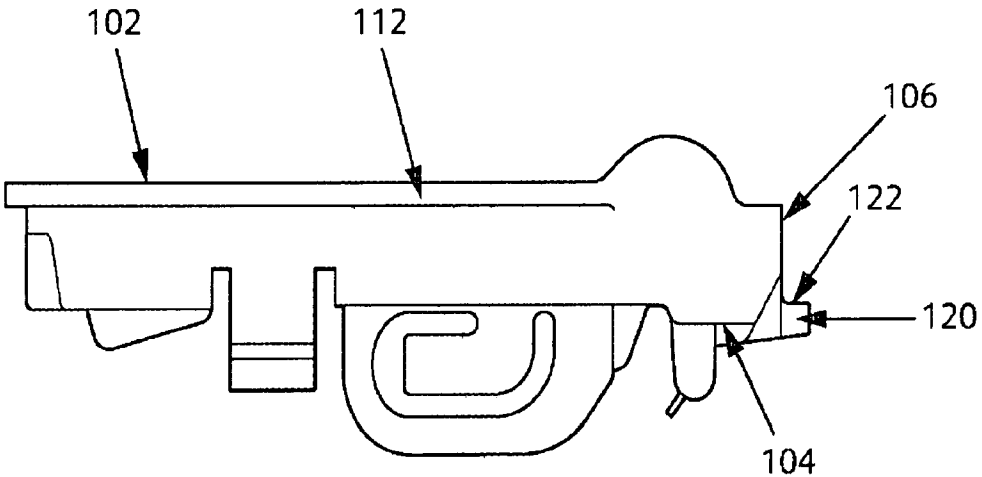

To prevent an inadvertent dislodging of the module 100 when force is applied to the door 200, a tab 120 is provided on the lower surface or underside 104 of the module 100 near the hinge 220 (see FIGS. 4 and 8). The tab 120 protrudes outwardly from the module 100 in a perpendicular direction with respect to the peripheral surface 106 of the module 100. The module 100 is inserted into the opening 12 at an angle to permit the tab 120 to slip under the inside surface 20 of the housing 10 (see FIGS. 3–5) and the latches 110 then slip into place (see FIG. 6).

Figure 7:
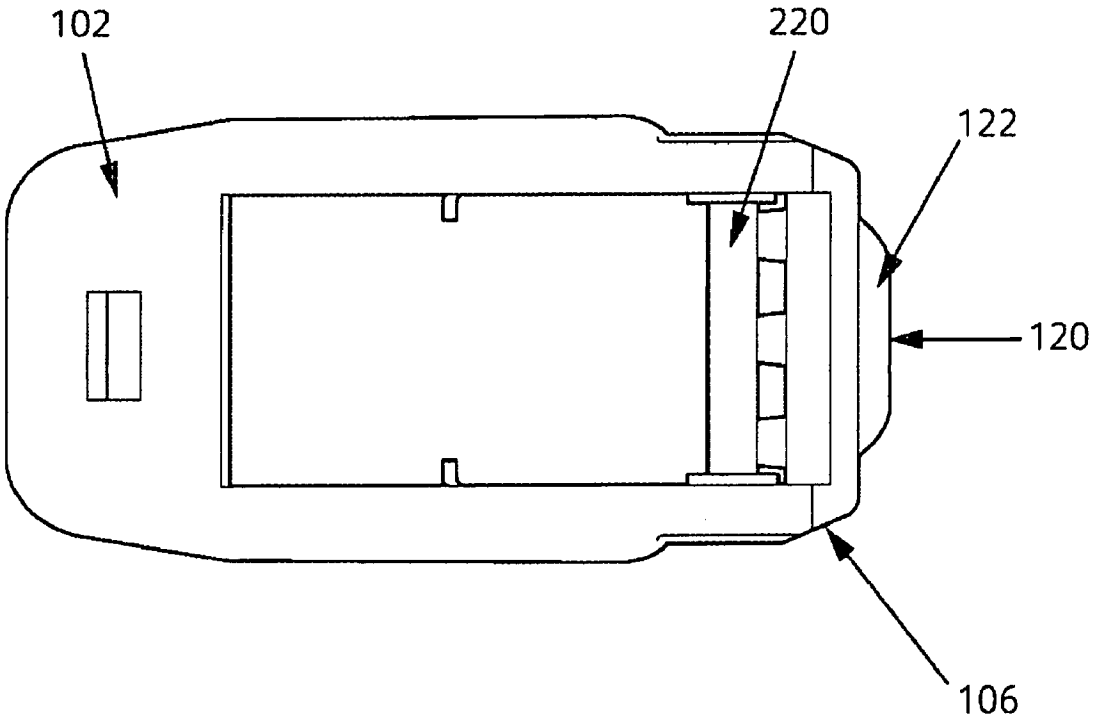
FIGS. 7 and 8 are drawings of the module of FIGS. 1–6.

When the module 100 is seated in the opening 12, the top or upper surface 122 of the tab 120 is adjacent and parallel to the inside surface 20 of the housing 10. When the door 200 is opened, the force applied to the door 200 is also applied through the module 100 to the upper surface 122 of the tab 120 in opposition to the immediately-abutting inside surface 20 of the hearing instrument housing 10. The depth (the horizontal dimension in FIG. 7) and width (the vertical dimension in FIG. 7) of the upper surface 122 are selected to provide adequate surface area for opposing the force applied by when the battery door is opened.

What is claimed is:

1. A hearing instrument, comprising:

a housing, the housing comprising inside and outside surfaces and an opening for an electronics module; and an electronics module for insertion into the opening of the hearing instrument housing, comprising:

generally parallel planar upper and lower surfaces;

a peripheral surface, located between the upper and lower surfaces and oriented generally perpendicular thereto, the peripheral surface conforming to the opening in the housing;

a door and hinge; and a tab in the vicinity of the hinge, the tab comprising a portion protruding outwardly from the module and having an orientation generally perpendicular to the peripheral surface, and comprising an upper surface generally coplanar with the lower surface of the module.

2. A hearing instrument as set forth in claim 1, where the inside surface of the hearing instrument housing is generally planar in the vicinity of the opening; and the upper surface of the tab is generally coplanar with and adjacent the inside surface of the housing when the module is seated in the opening of the housing, such that the upper surface of the tab opposes the inside surface of the housing.

3. A hearing instrument as set forth in claim 1, where the module further comprises a flange contiguous with the upper surface of the module, where the flange rests on the outside surface of the housing when the module is seated in the opening of the housing.

4. A module for insertion into an opening in a hearing instrument housing, where the housing comprises inside and outside surfaces, comprising:

generally parallel planar upper and lower surfaces;

a peripheral surface, between the upper and lower surfaces and generally perpendicular thereto, the peripheral surface conforming to the opening in the housing;

a door and hinge; and a tab in the vicinity of the hinge, the tab comprising a portion protruding outwardly from the module and having an orientation generally perpendicular to the peripheral surface, and comprising an upper surface generally coplanar with the lower surface of the module.

5. A module as set forth in claim 4, where the inside surface of the hearing instrument housing is generally planar in the vicinity of the opening; and the upper surface of the tab is generally coplanar with and adjacent the inside surface of the housing when the module is seated in the opening of the housing, such that the upper surface of the tab opposes the inside surface of the housing.

6. A module as set forth in claim 4, further comprising a flange contiguous with the upper surface of the module, where the flange rests on the outside surface of the housing when the module is seated in the opening of the housing.

7. A force-opposing tab for a hearing instrument module residing in an opening in a hearing instrument housing, where the housing comprises an inside surface, and the module comprises generally parallel planar upper and lower surfaces, a peripheral surface between the upper and lower surfaces and generally perpendicular thereto, the peripheral surface conforming to the opening in the housing, and a door and hinge;

the tab comprising:

a member in the vicinity of the hinge, the member comprising a portion protruding outwardly from the module and having an orientation generally perpendicular to the peripheral surface, and comprising an upper surface generally coplanar with the lower surface of the module.

8. A force-opposing tab as set forth in claim 7, where the inside surface of the hearing instrument housing is generally planar in the vicinity of the opening; and the member is located on the lower surface of the module and comprises an upper surface generally coplanar with and adjacent the inside surface of the housing when the module is seated in the opening of the housing, such that the upper surface of the member opposes the inside surface of the housing.

* * * * *